US006959582B2

(12) United States Patent
Peterhansel et al.

(10) Patent No.: US 6,959,582 B2
(45) Date of Patent: Nov. 1, 2005

(54) EXPANDABLE FORMING TOOL

(75) Inventors: Carl R. Peterhansel, Unionville, CT (US); Jonathan W. Chomicz, Clinton, CT (US)

(73) Assignee: Trumpf Inc., Farmington, CT (US)

( * ) Notice: Subject to any disclaimer, the term of this patent is extended or adjusted under 35 U.S.C. 154(b) by 162 days.

(21) Appl. No.: 10/660,022

(22) Filed: Sep. 11, 2003

(65) Prior Publication Data

US 2004/0065136 A1 Apr. 8, 2004

Related U.S. Application Data

(63) Continuation-in-part of application No. 10/264,909, filed on Oct. 4, 2002, now abandoned.

(51) Int. Cl.[7] ..... B21D 5/01
(52) U.S. Cl. ..... 72/395; 73/393; 73/452.9
(58) Field of Search ..... 72/393, 395, 392, 72/452.8, 394, 452.9, 399, 324

(56) References Cited

U.S. PATENT DOCUMENTS 1,053,476 A 2/1913 Brown
1,680,650 A * 8/1928 Travis ..... 72/293
2,728,316 A 12/1955 Oberg et al.
2,937,687 A * 5/1960 Gould ..... 72/393
3,060,994 A * 10/1962 Larsen et al. ..... 72/392
3,314,276 A * 4/1967 Peyton et al. ..... 72/370.08
3,803,896 A * 4/1974 Cermak et al. ..... 72/353.4
3,890,869 A 6/1975 Van Cleave
3,943,744 A 3/1976 Marsh et al.
3,971,244 A 7/1976 Zengerer
4,519,235 A 5/1985 Gauck
5,392,629 A 2/1995 Goss et al.
5,778,721 A * 7/1998 Klingel et al. ..... 72/335
6,189,361 B1 2/2001 Seki et al.
2003/0188564 A1 10/2003 Wade

* cited by examiner

*Primary Examiner*—Daniel C. Crane

(57) ABSTRACT

An expandable forming tool has a body with a mounting stem on its upper surface and a transversely extending channel in its lower surface in which is slidably seated a wedge-shaped actuator for vertical sliding movement. The larger lower end normally depends from the body. A pair of slides are slidably seated in the channel on opposite sides of the actuator, and they have angular surfaces slidably bearing on the sloping surfaces of the actuator. Springs bias the slides against the side surfaces of the actuator, and a spring biases the actuator outwardly of the body. The actuator is driven vertically inwardly of the channel by movement of its larger end against a workpiece, and this inward movement pushes the slide members outwardly in the channel to project beyond the periphery of the body. The tool can produce contours in the workpiece, or cut the workpiece, or both.

21 Claims, 11 Drawing Sheets

EXPANDABLE FORMING TOOL

CROSS-REFERENCE TO RELATED APPLICATIONS

The present application is, now abandoned a continuation-in-part of our application Ser. No. 10/264,909 filed Oct. 4, 2002.

BACKGROUND OF THE INVENTION

The present invention relates to tools for forming and cutting sheet metal workpieces and the like.

Machine tools are widely utilized to form sheet metal workpieces into a desired configuration by cooperating upper and lower dies which are configured to provide the contours in the workpiece. The configured forming tool is located in the head of the machine and is moved downwardly against the workpiece which is disposed upon a die that cooperates with the forming tool. Many of such dies have a resiliently deformable portion which facilitates the forming of the metal about the contours of the forming tool. Such tooling may simply deform the workpiece to provide the desired contours and the cooperating surfaces of the components will generally have radiused edges. Other tooling may cut through the workpiece and their components will have sharp cooperating edges to shear the workpiece. Some tooling may provide both forming and cutting action by the providing forming edges about a portion of the periphery and cutting edges about the remainder of the periphery.

The terms "forming" and "forming tools" as used herein encompass tools which merely form the workpiece into a desired configuration, tools which cut through the workpiece, and tools which combine both forming and cutting actions.

Generally, machine tools have a limitation as to the diameter of the forming tool which can be employed. If that diameter of the conventional forming tool is less than the length of the contour to be formed, multiple operations may be required to effect the formation of the full length of the desired contour. This is costly in terms of time required, and it can require use of multiple tools to obtain the desired formation.

It is an object of the present invention to provide a novel forming tool which can be expanded beyond the normal maximum diameter for the forming tool to enable the forming of a workpiece over a wider length.

It is also an object to provide such a forming tool which can be readily and relatively economically fabricated to provide a relatively long lived assembly.

SUMMARY OF THE INVENTION

It has now been found that the foregoing and related objects may be readily attained in an expandable forming tool having a body with a mounting stem on its upper surface and a transversely extending channel in its lower surface. A wedge-shaped actuator has its smaller, upper end slidably seated in the channel for movement vertically therein and has its larger, lower end normally depending from the body. The actuator has inwardly sloping side surfaces which bear against cooperatively sloping side surface of a pair of slide members slidably seated in the channel on opposite sides of the wedge-shaped actuator.

Slide member biasing means biases the slide members against the sloping surfaces of the actuator, and actuator biasing means biases the actuator outwardly of the body. The actuator is driven vertically inwardly of the channel by movement of the larger lower end against an opposing surface usually provided by a cooperating die, and the inward movement of the actuator pushes the slide members outwardly in the channel so as to project beyond the periphery of the body.

Generally, the actuator and the slide member may have their lower surfaces cooperatively configured to form a contour in a workpiece against which they are driven, or the edges of the lower surfaces may be sharp to cut through the workpiece, or both sharp and radiused edges in different portions may be provided to both form and cut different portions of a workpiece. To do, so the bottom surfaces cooperate with similar edges on the top surface of a die underlying the workpiece. Moreover, the slide member and the larger end of the actuator have their lower surfaces lying in a common plane when the actuator is fully moved inwardly of the body.

The body has depending portions at the upper and outer ends of the channel and the slides have cooperating upstanding portions at their inner ends. The slide member biasing means comprises compression springs seated between these depending and upstanding portions.

The stem and the body have aligned axial passages therein opening into the channel, and an actuator retainer is slidably seated in the axial passages. The actuator biasing means includes a compression spring acting between the upper end portion of the actuator retainer and a shoulder in the passage in the stem. Preferably, the axial passage in the body has a shoulder formed thereabout adjacent its upper end and the actuator retainer has a collar which abuts the upper surface of the shoulder to retain the actuator in the body.

As will be readily appreciated, the punch or forming tool cooperates with a die having an upper surface which is generally complimentary to the lower surface of the forming tool or punch. Sharp edges are provided in portions where the workpiece is to be cut and arcuate edges are provided where the workpiece is to be contoured.

BRIEF DESCRIPTION OF ATTACHED DRAWINGS

Figure 8:
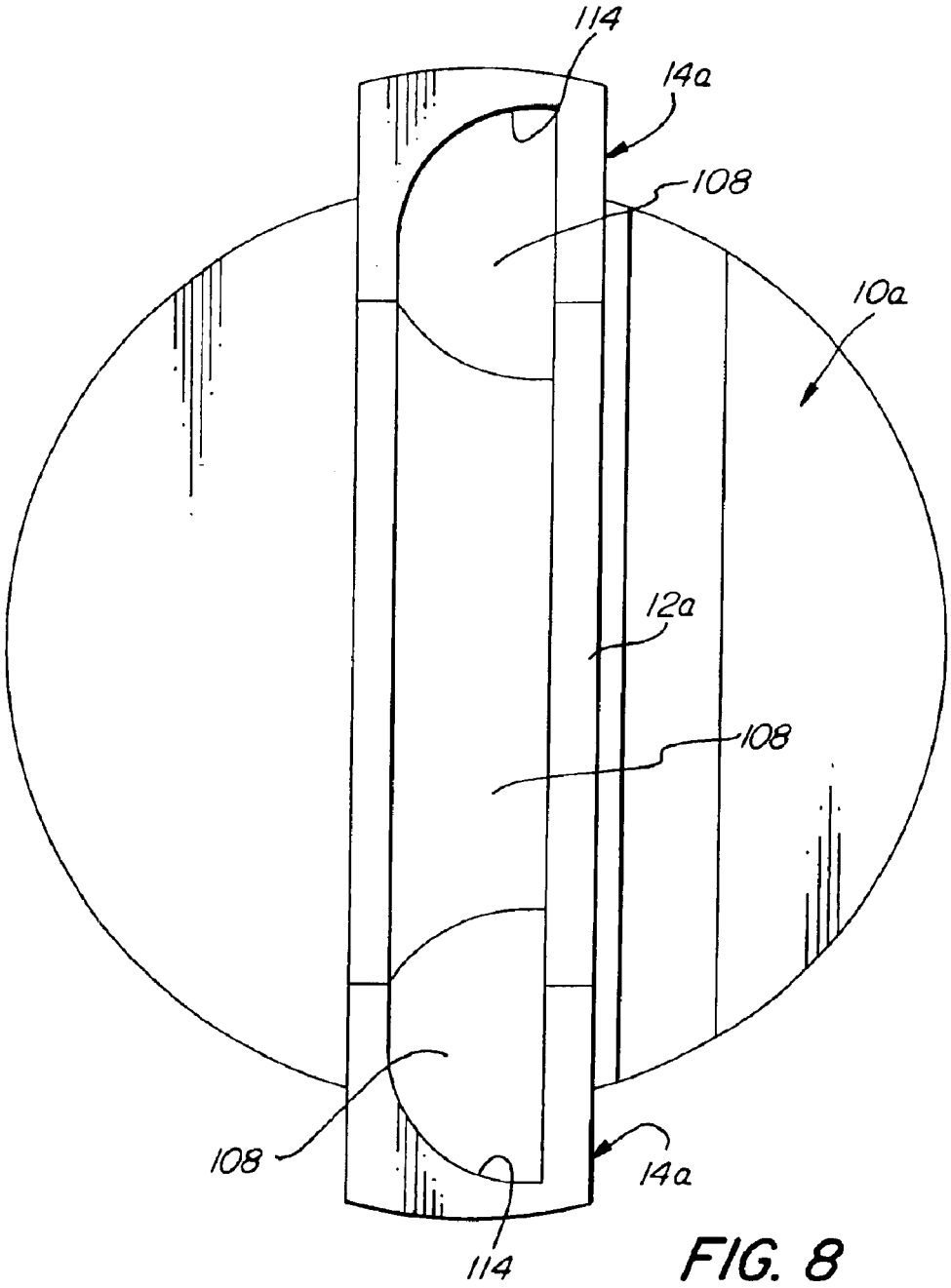
Figure 9:
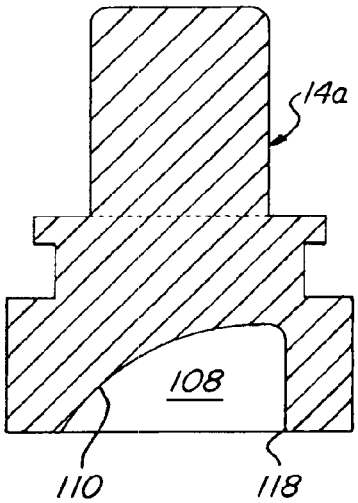
Figure 10:
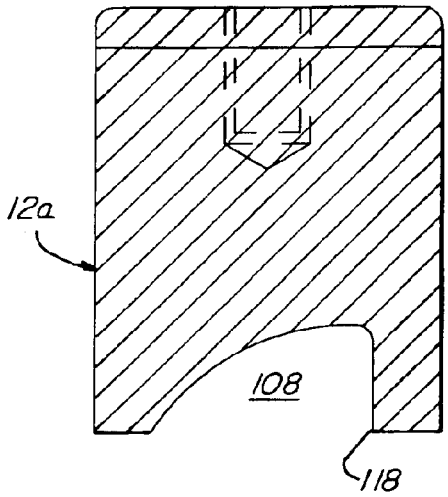
Figure 11:
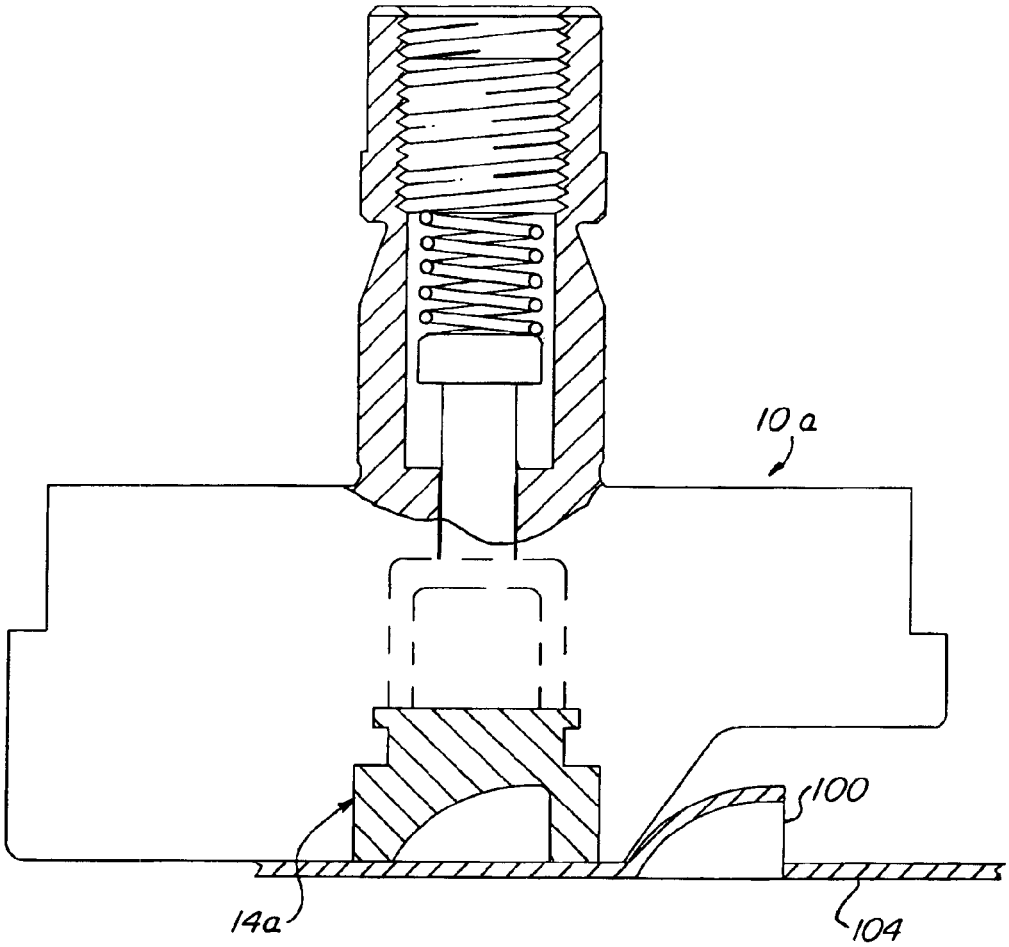
Figure 12:
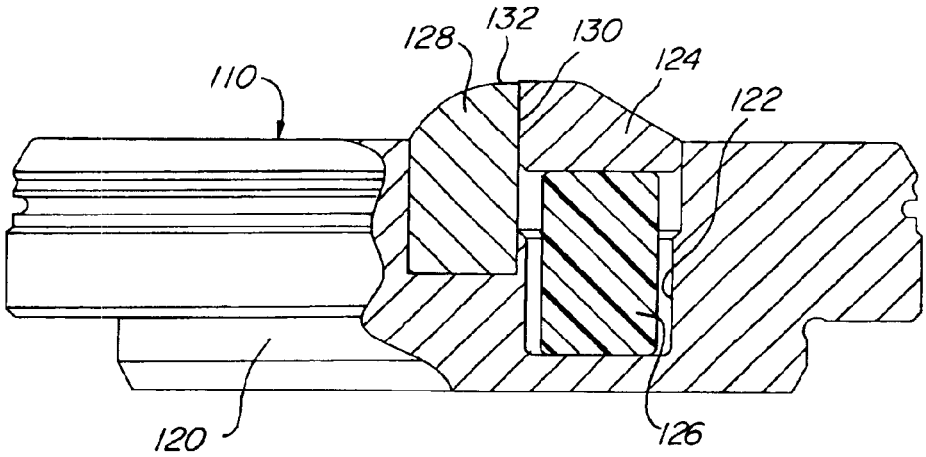
Figure 14:
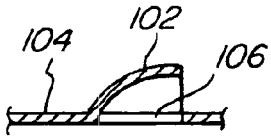
Figure 13:
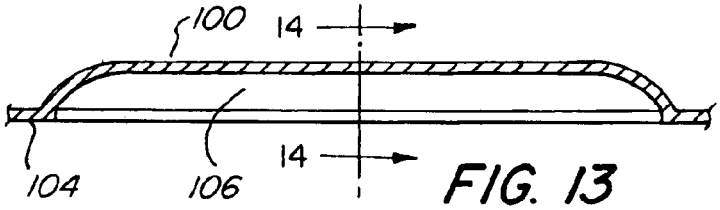

FIGS. 7*a*–7*e* are cross sectional views drawn to a reduced scale of the expandable forming tool and a cooperating die at various states of relative movement;

FIG. 8 is a bottom view of another embodiment of a forming tool embodying the present invention for both cutting and forming a contour in the workpiece, and with the slides extended;

FIG. 9 is a cross sectional view of a slide in the tool of FIG. 8;

FIG. 10 is a cross sectional view of the actuator in the tool of FIG. 8;

FIG. 11 is an elevational view of the tool of FIG. 8 in partial cross section showing the tool in the process of forming a second louver in the workpiece;

FIG. 12 is a fragmentary sectional view of the die cooperating with the forming tool of FIG. 8;

FIG. 13 is a fragmentary cross sectional view of a workpiece which has been cut and contoured by the forming tool of FIG. 8; and FIG. 14 is a fragmentary cross sectional view along the line 14—14 or FIG. 13.

DETAILED DESCRIPTION OF THE PREFERRED EMBODIMENT

An expandable forming tool embodying the present invention is shown in the attached drawings and is generally comprised of a body generally designated by the numeral 10, an actuator generally designated by the numeral 12, and a pair of slides generally designated by the numeral 14.

The body 10 comprises a generally circular housing 16 with a transversely extending channel 18 in its lower surface terminating in depending end walls 20. A concentric, generally cylindrical stem 22 on the upper surface has a bore or passage 24 extending therethrough. The upper end portion of the bore 24 is threaded and receives a threaded cap 26 and the lower portion seats a compression spring 28 which bears upon the cap 26. A concentric passage 27 extends through the body 10 from the bore 24 to the channel 18.

Slidably seated in the channel 18 are the slides 14 which have their bottom surface 29 configured to form the desired contour in a workpiece and an upstanding portion 30 on their inner ends which cooperate with the depending end walls 20 of the body to define recesses 31 in which are seated compression springs 32 which bias the slides 14 inwardly. The lower portions 34 of the inner end surface of the slides 14 are angled outwardly downwardly.

The actuator 12 is generally wedge shaped with outer end surfaces 36 which angled outwardly downwardly to cooperate with the lower portions 34 of the slides 14. The bottom surface 38 of the actuator is contoured cooperatively with the bottom surfaces 29 of the slides 14 to produce the desired contour in the workpiece.

Figure 1:
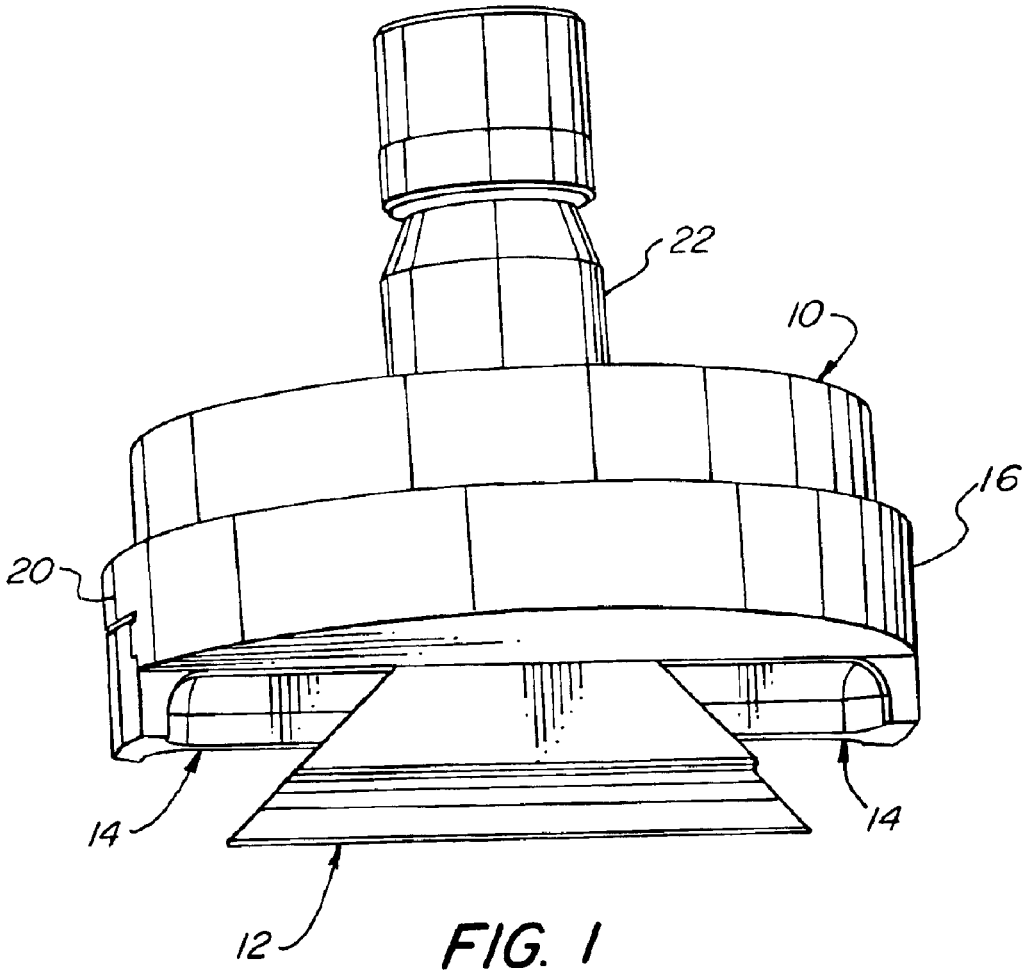
FIG. 1 is a perspective view of an expandable forming tool embodying the present invention.
Figure 2:
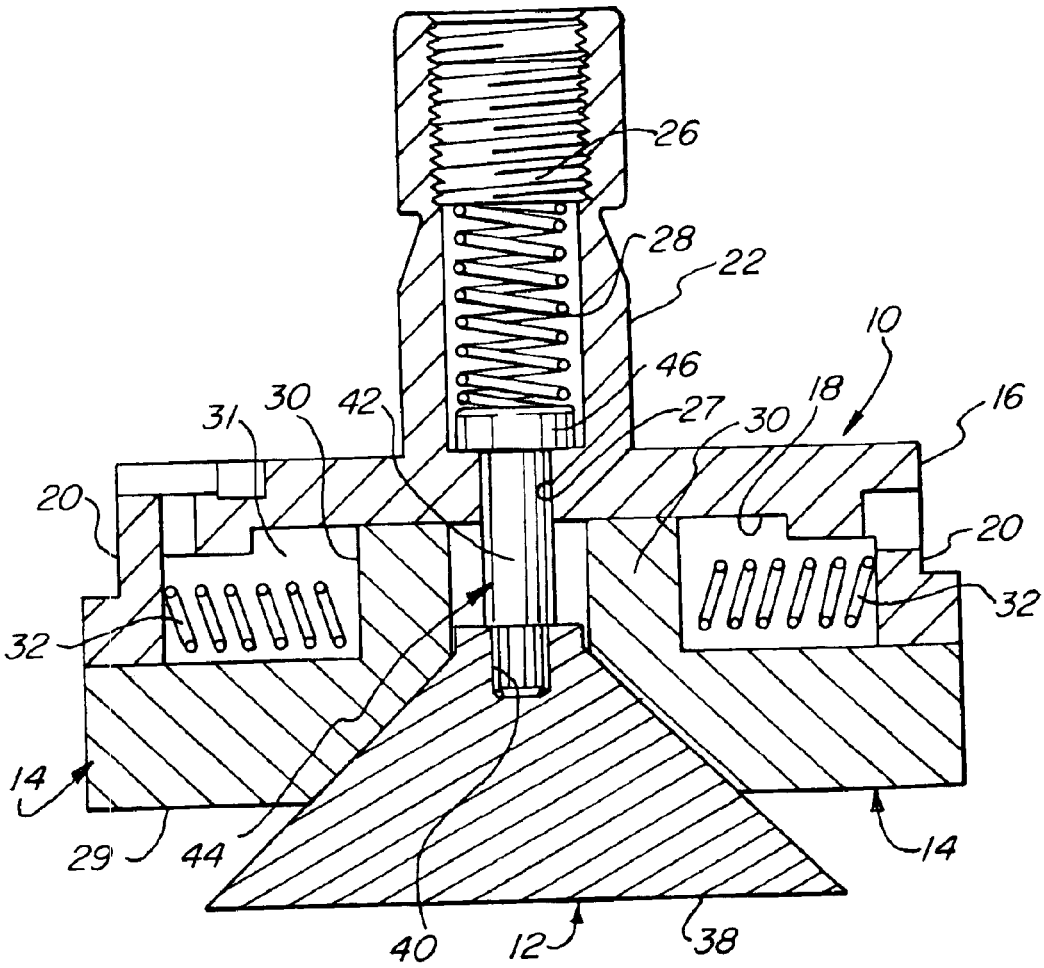
FIG. 2 is a cross sectional view thereof.
Figure 3:
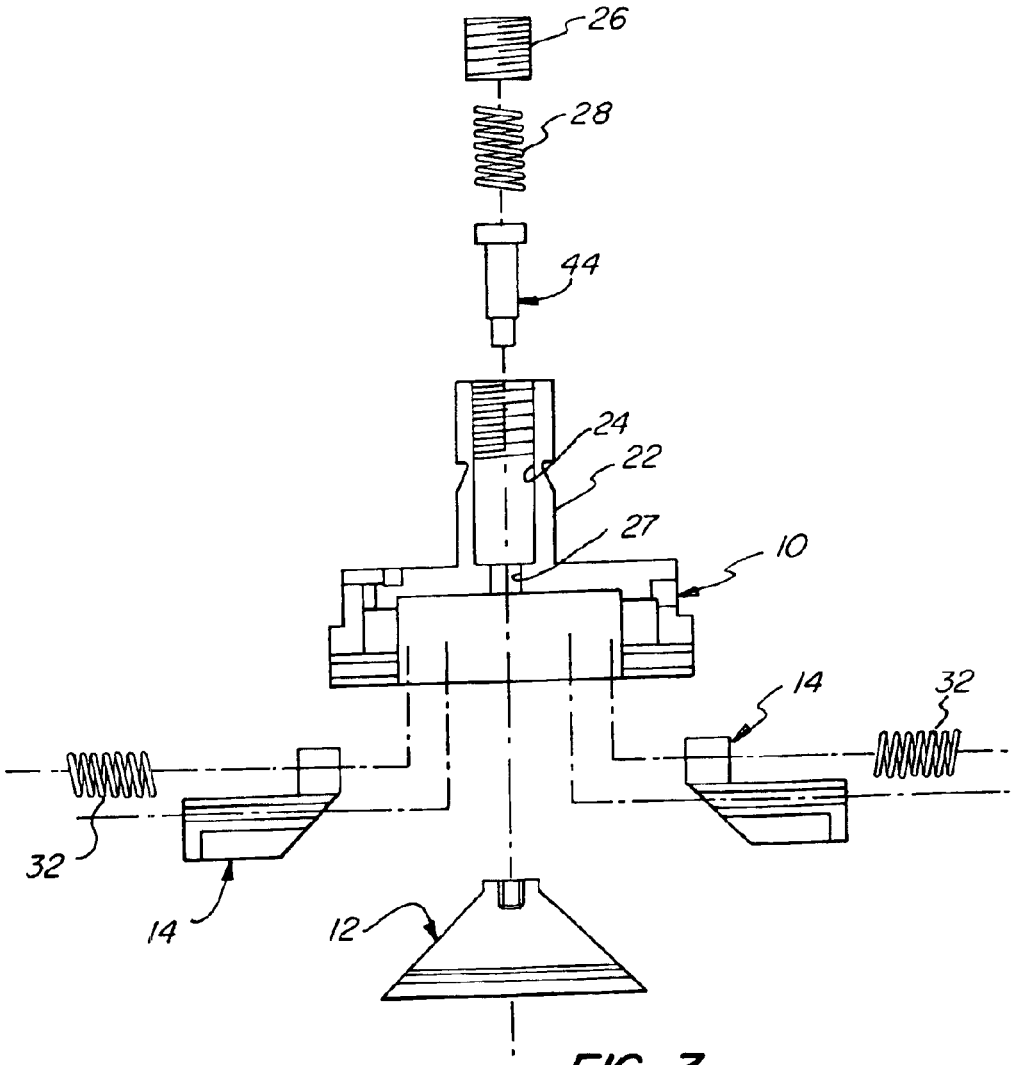
FIG. 3 is an exploded view thereof.
Figure 5:
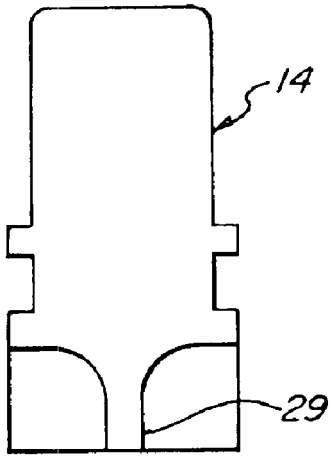
FIG. 5 is an end elevational view of a slide.
Figure 4:
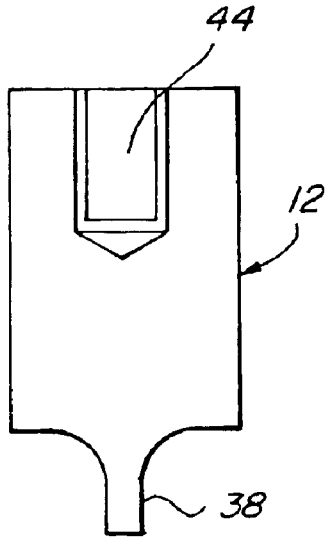
FIG. 4 is a cross sectional view of the actuator drawn to an enlarged scale.
Figure 6:
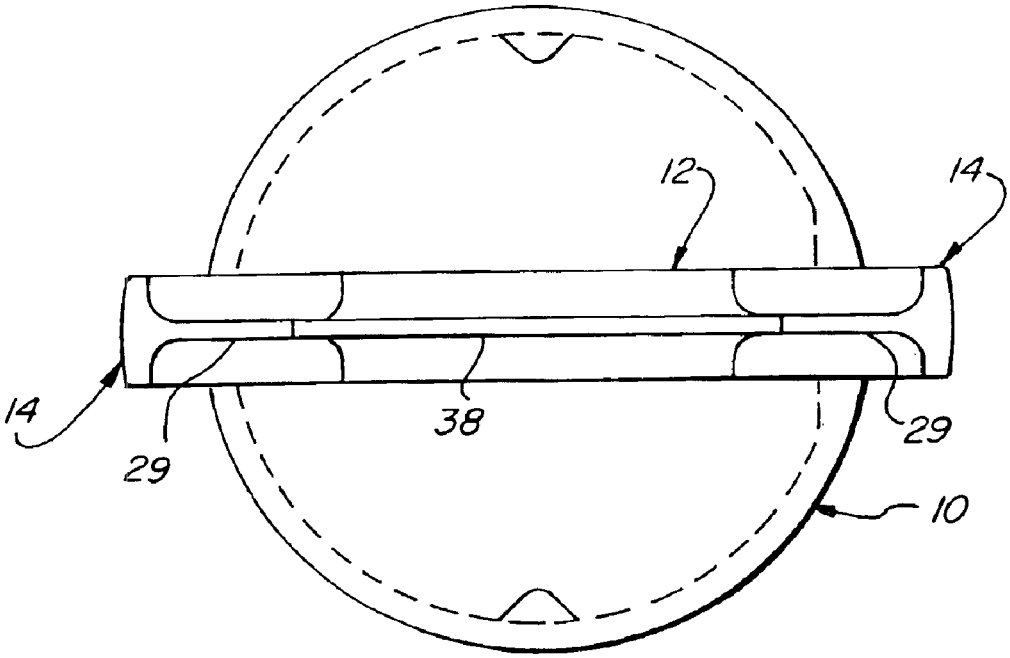
FIG. 6 is a bottom view of the forming tool with the slides extended.

The upper end of the actuator 12 has a threaded bore 40 which threadably seats the shank 42 of the bolt generally designated by the numeral 44 and which extends through the passage 27 in the body 10. The spring 28 bears upon the head 46 of the bolt 44 to bias the actuator 12 outwardly of the channel 18 in the body 10 as seen in FIG. 1 in which position the slides 12 are disposed within the periphery of the body 10.

In accordance with conventional practice, the expandable forming tool of FIGS. 1–6 cooperates with a die shown in FIGS. 7*a*–7*e* and generally designated by the numeral 48 to deform a sheet metal workpiece schematically illustrated and designated by the numeral 50.

As will be readily appreciated, the actuator 12 is retained in the body 10 by the retainer bolt 44. Since the actuator 12 is positively held in place, this also effects the retention of the slides 14 within the body 10.

In assembling the forming tool of the present invention, the slides 14 and the compression springs 32 are initially assembled in the body 10. The actuator 12 is then moved into place between them and the bolt 44 is threadably engaged therein. The compression spring 28 is then placed within the passage 24 in the stem 22, and the cap 26 is threaded inwardly of the stem to trap the spring 28 in position and to hold all of the elements in assembly.

Figure 7A:
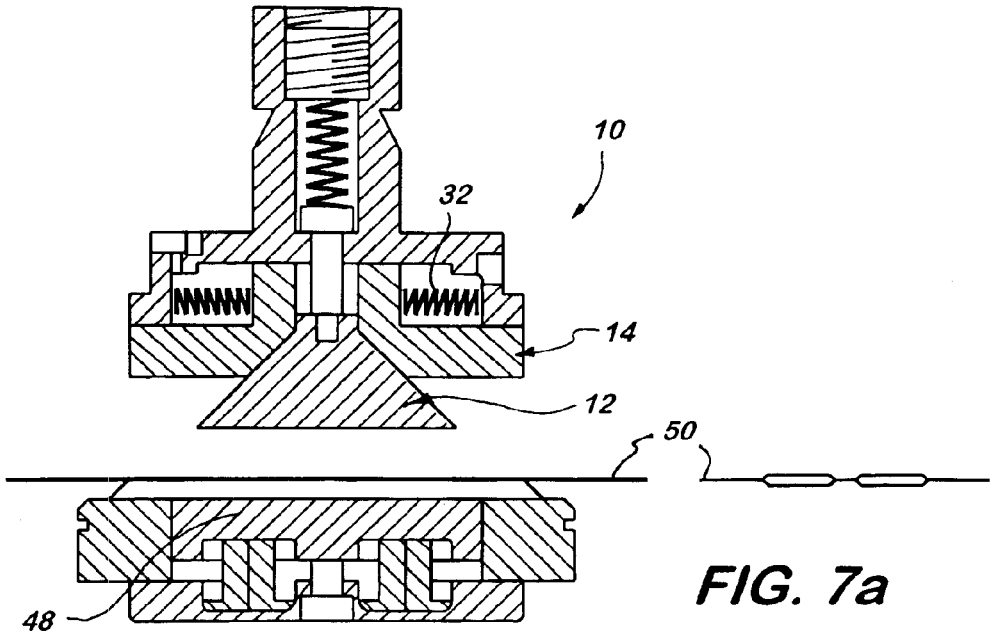

Turning now to FIGS. 7*a*–7*e*, the operation of the expandable tool is diagrammatically illustrated. In FIG. 7*a*, the forming tool has been clamped in position in the machine tool (not shown) and the actuator 12 is in its at rest position extending substantially outwardly of the body 10. The springs 32 are biasing the slides 14 against its side surfaces of the actuator 12 so that they are fully disposed within the periphery of the body 10. The sheet material workpiece 50 is disposed on the die 48 located in the bed of the machine tool (not shown).

Figure 7B:
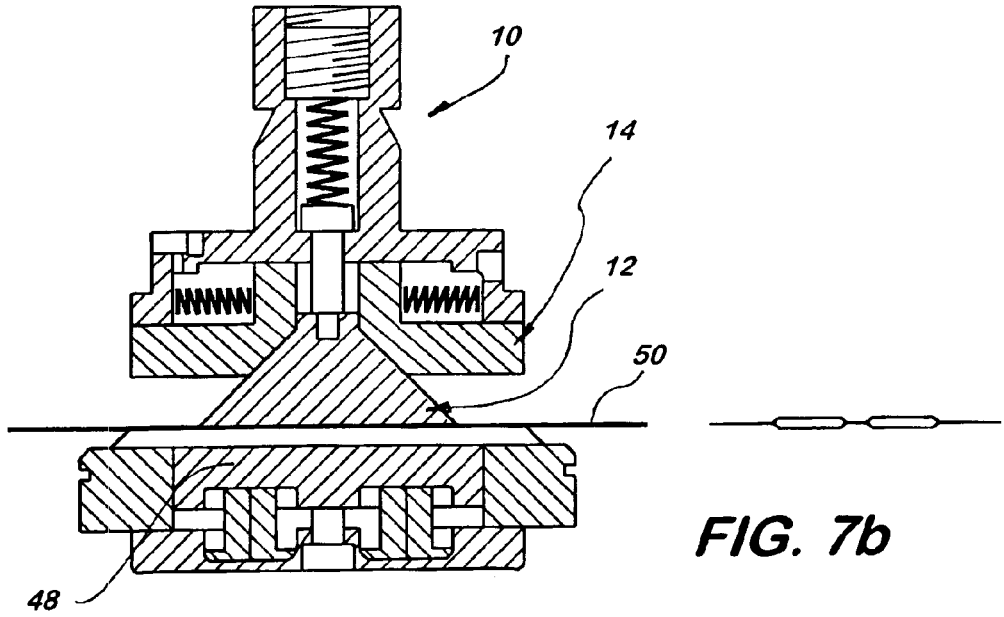
Figure 7C:
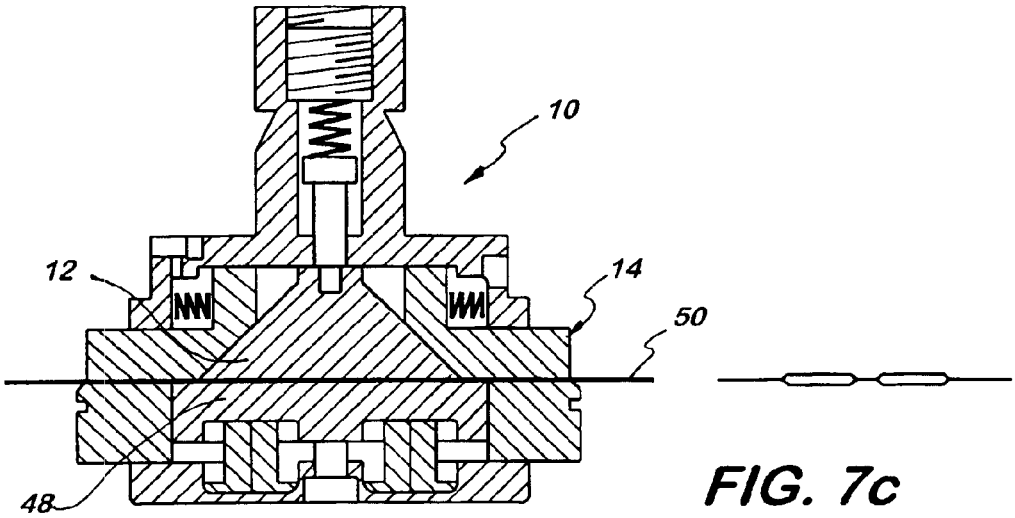
Figure 7D:
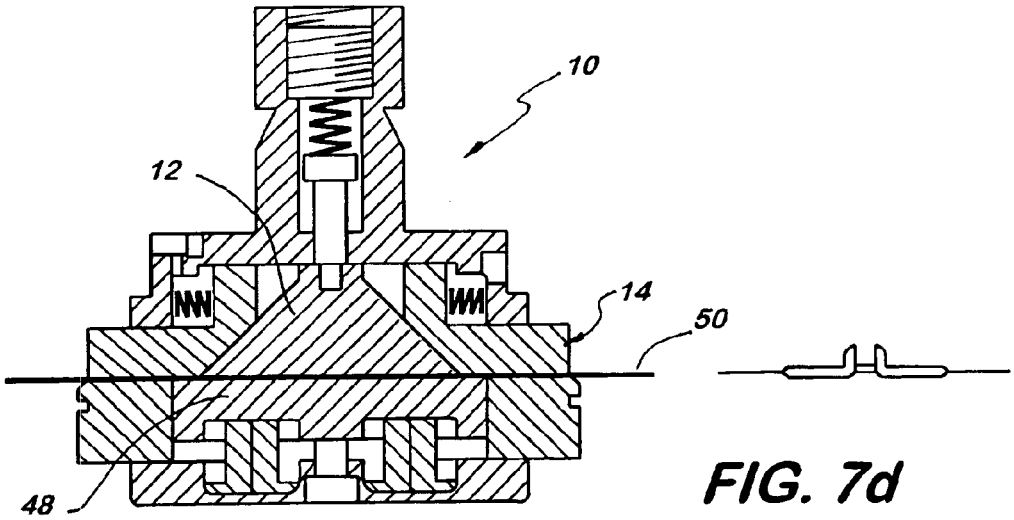

In FIG. 7*b*, the forming tool has been moved against the surface of the workpiece 50. In FIG. 7*c*, the continuing movement of the forming tool against the workpiece 50 has caused the actuator 12 to move vertically upwardly and this, in turn, has caused the slides 14 to move outwardly into the projecting positions which are illustrated. The bottom surfaces of the slides 14 and actuator 12 with the contours thereon are all aligned in a common plane. The continuing motion of the forming tool now causes the underlying deflectable portion of the die 48 to compress and deform about the workpiece to effect its bending until it assumes the shape shown in FIG. 7*d* across the full width of the expanded tool, i.e., the actuator and the projecting slides.

Figure 7E:
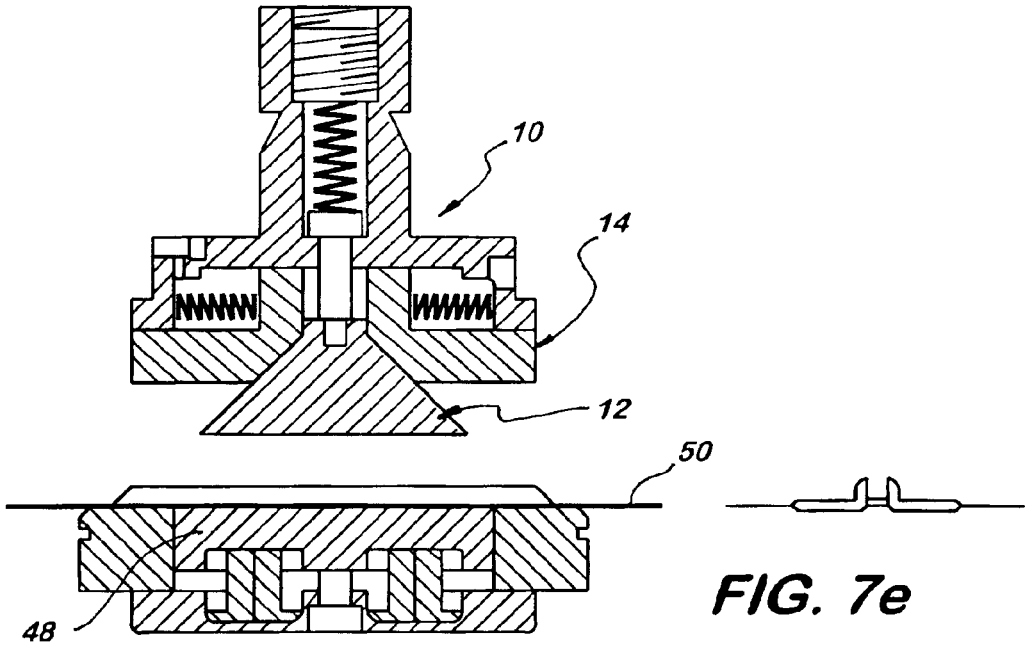

In FIG. 7*e*, the machine tool has now moved the forming tool upwardly so that the workpiece 50 can be removed.

Turning next to FIGS. 8–10, therein illustrated is a forming tool which will both cut and contour the workpiece in a single stroke. The basic structure of the tool is the same as that illustrated in FIGS. 1–7 except for the bottom or working surface of the tool, and the parts have the same reference numerals with the letter "a" appended thereto.

FIGS. 11 and 12 illustrate a part produced thereby with a louver opening 100 formed therein. An arcuate wall 102 extends away from the plane of the workpiece 104 along the length thereof to provide an opening 106 for air to pass therethrough and thence through the louver 100. The ends of the louver 100 are formed with a similar arcuate configuration.

In the tool of FIGS. 8–10, the louver surfaces of the slides 14*a* and actuator 12*a* are machined to provide cooperating and aligned recesses 108 which have an arcuate portion 110 corresponding to the arcuate wall 102 and a sharp edge portion 118 to cut through the workpiece 104 and provide the opening 106. The ends 112 of the recesses 108 in the slides 14*a* are arcuate to produce the arcuate ends of the louver formation.

The forming tool illustrated in FIGS. 8–10 cooperates with the die illustrated in FIG. 12 and generally designated by the numeral 110. The die 110 is comprised of a body 120 having a stepped channel 112 formed in its upper surface in which is seated the ejector 124 and the resiliently compressible member 126. A rib 128 borders the channel and has a sharp edge 120 at the upper end of the vertical face which is aligned with the channel 112 and an arcuate surface 122. In another embodiment, the rib 118 may be provided by a readily replaceable insert seated in a channel adjacent the channel 112. The sharp edge 130 of the forming tool 100 cooperates with the sharp edge 120 of the die 110 to cut the metal and allow the adjacent portion of the workpiece 104 to form about the adjacent arcuate surface 122 of the die.

As can be seen from the foregoing detailed drawings and description, the expandable forming tool of the present invention may be fabricated readily easily and economically and provides an expanded forming surface. This enables the fabrication of workpieces more quickly and enables far less complex forming dies than might otherwise be required.

Having thus described the invention, what is claimed is:

1. An integrated expandable forming tool having:

(a) a body with a mounting stern on its upper surface for mounting in a punch press and a transversely extending channel in its lower surface;

(b) a wedge-shaped actuator having its smaller end slidably seated in said channel for movement vertically therein and having its larger end normally depending from said body and having an end surface for impacting upon a workpiece, said actuator having upwardly inwardly sloping side surfaces;

(c) a pair of slide members slidably seated in said channel on opposite sides of said wedge-shaped actuator and having cooperating angular surfaces slidably bearing on said sloping side surfaces of said actuator;

(d) slide member spring biasing means biasing said slide members against said sloping side surfaces of said actuator; and (e) actuator spring biasing means biasing said actuator outwardly of said body, said actuator being driven vertically inwardly of said channel by movement of said larger end against an opposing surface by movement of the ram of the punch press, said inward movement of said actuator pushing said slide members outwardly in said channel so as to project beyond the periphery of said body.

2. The expandable forming tool in accordance with claim 1 wherein said actuator and said slide members have their lower surfaces cooperatively configured to form a contour in a workpiece against which they are driven.

3. The expandable forming tool in accordance with claim 1 wherein said actuator and slide members have their lower surfaces cooperatively configured to cut through a workpiece against which they are driven.

4. The expandable forming tool in accordance with claim 1 wherein said actuator and slide members have their lower surfaces cooperatively configured to provide edge surfaces in a portion thereof to cut through the workpiece and edge surfaces in portions thereof to form the workpiece thereabout.

5. The expandable forming tool in accordance with claim 1 wherein said slide member and said larger end of said actuator have their lower surfaces lying in a common plane when said actuator is fully moved inwardly of said body.

6. The expandable forming tool in accordance with claim 1 wherein said body has depending portions at the upper and outer ends of said channel and said slides have cooperating upstanding portions at their inner ends.

7. The expandable forming tool in accordance with claim 6 wherein said slide member biasing means comprises compression springs seated between said depending and upstanding portions.

8. The expandable forming tool in accordance with claim 1 wherein said stem and said body have aligned axial passages therein opening into said channel, and wherein an actuator retainer is slidably seated in said axial passages.

9. The expandable forming tool in accordance with claim 8 wherein said actuator biasing means includes a compression spring acting between said actuator retainer and a shoulder in said passage.

10. The expandable forming tool in accordance with claim 9 wherein said axial passage in said body has a shoulder formed thereabout adjacent its upper end and said actuator retainer has a collar about its lower end, said collar abutting the upper surface of said shoulder to retain said actuator in said body.

11. A punch and die assembly for forming a contour in a workpiece comprising:

(a) an expandable forming tool having:

(i) a body with a mounting stem on its upper surface and a transversely extending channel in its lower surface;

(ii) a wedge-shaped actuator having its smaller end slidably seated in said channel for movement vertically therein and having its larger end normally depending from said body, said actuator having upwardly inwardly sloping side surfaces;

(iii) a pair of slide members slidably seated in said channel on opposite sides of said wedge-shaped actuator and having cooperating angular surfaces slidably bearing on said sloping side surfaces of said actuator;

(iv) slide member biasing means biasing said slide members against said sloping side surfaces of said actuator; and (v) actuator biasing means biasing said actuator outwardly of said body, said actuator being driven vertically inwardly of said channel by movement of said larger end against an opposing surface, said inward movement of said actuator pushing said slide members outwardly in said channel so as to project beyond the periphery of said body, said slide members and actuator having their lower surfaces cooperatively configured to form a contour in a workpiece against which they are driven; and (b) a die having an upper surface configured cooperatively with respect to the lower surfaces of said slide members and actuator to form the workpiece into a desired contour.

12. The punch and die assembly in accordance with claim 11 wherein said slide member and said larger end of said actuator have their lower surfaces lying in a common plane when said actuator is fully moved inwardly of said body.

13. The expandable forming tool in accordance with claim 11 wherein said body has depending portions at the upper and outer ends of said channel and said slides have cooperating upstanding portions at their inner ends.

14. The expandable forming tool in accordance with claim 13 wherein said slide member biasing means comprises compression springs seated between said depending and upstanding portions.

15. The expandable forming tool in accordance with claim 11 wherein said stem and said body have aligned axial passages therein opening into said channel, and wherein an actuator retainer is slidably seated in said axial passages.

16. The expandable forming tool in accordance with claim 11 wherein said actuator biasing means includes a compression spring acting between said actuator retainer and a shoulder in said passage.

17. A punch and die assembly for forming a contour in a workpiece comprising:

(a) an expandable forming tool having:

(i) a body with a mounting stem on its upper surface and a transversely extending channel in its lower surface;

(ii) a wedge-shaped actuator having its smaller end slidably seated in said channel for movement vertically therein and having its larger end normally depending from said body, said actuator having upwardly inwardly sloping side surfaces;

(iii) a pair of slide members slidably seated in said channel on opposite sides of said wedge-shaped actuator and having cooperating angular surfaces slidably bearing on said sloping side surfaces of said actuator;

(iv) slide member biasing means biasing said slide members against said sloping side surfaces of said actuator; and (v) actuator biasing means biasing said actuator outwardly of said body, said actuator being driven vertically inwardly of said channel by movement of said larger end against an opposing surface, said inward movement of said actuator pushing said slide members outwardly in said channel so as to project beyond the periphery of said body, said actuator and slide members having their lower surfaces cooperatively configured to cut through a workpiece against which they are driven; and (b) a die having an upper surface configured cooperatively with respect to the lower surfaces of said slide members and actuator to cut the workpiece.

18. The punch and die assembly in accordance with claim 17 wherein said slide member and said larger end of said actuator have their lower surfaces lying in a common plane when said actuator is fully moved inwardly of said body.

19. The punch and die assembly in accordance with claim 17 wherein said body has depending portions at the upper and outer ends of said channel and said slides have cooperating upstanding portions at their inner ends.

20. The punch and die assembly in accordance with claim 17 wherein said slide member biasing means comprises compression springs seated between said depending and upstanding portions.

21. The punch and die assembly in accordance with claim 17 wherein said actuator and slide members have their lower surfaces cooperatively configured to provide edge surfaces in a portion thereof to cut through the workpiece and edge surfaces in portions thereof to form the workpiece thereabout.

* * * * *